US007811649B2

(12) United States Patent
Post

(10) Patent No.: US 7,811,649 B2
(45) Date of Patent: Oct. 12, 2010

(54) ROLL OF INTERCONNECTED DETACHABLE FABRIC/CLOTH SHEETS

(76) Inventor: David W. Post, 61 Beech Hill Rd., Pleasantville, NY (US) 10570

( * ) Notice: Subject to any disclaimer, the term of this patent is extended or adjusted under 35 U.S.C. 154(b) by 0 days.

(21) Appl. No.: 12/290,433

(22) Filed: Oct. 30, 2008

(65) Prior Publication Data

US 2009/0130364 A1 May 21, 2009

Related U.S. Application Data

(60) Provisional application No. 61/003,838, filed on Nov. 20, 2007.

(51) Int. Cl.
*B32B 3/06* (2006.01)

(52) U.S. Cl. ..... 428/57; 428/100; 428/906; 206/820

(58) Field of Classification Search ..... 428/57, 428/99, 100, 906, 54; 206/390, 820; 15/228; 242/160.4, 917–919, 160.3
See application file for complete search history.

(56) References Cited

U.S. PATENT DOCUMENTS 2,170,147 A * 8/1939 Lane ..... 206/447
4,620,396 A * 11/1986 Bjorntwedt ..... 52/3
5,378,522 A * 1/1995 Lagomarsino ..... 428/100
5,388,300 A * 2/1995 Hickey ..... 15/104.2
5,904,289 A 5/1999 Hagan
7,032,751 B2 * 4/2006 Bell et al. ..... 206/390
2004/0106342 A1 6/2004 Sturm et al.
2004/0258876 A1 12/2004 Leslie
2004/0259447 A1 * 12/2004 Elkouh et al. ..... 442/121
2005/0208858 A1 * 9/2005 Dillinger ..... 442/327
2007/0061938 A1 3/2007 Reimer

FOREIGN PATENT DOCUMENTS

DE 202 02 949 U1 8/2002
JP 2004329500 11/2004

* cited by examiner

*Primary Examiner*—Alexander Thomas
(74) *Attorney, Agent, or Firm*—Robert L. Epstein; Epstein Drangel Bazerman & James, LLP

(57) ABSTRACT

A roll of interconnected detachable fabric or cloth sheets provides an environmentally friendly cost effective reusable alternative to disposable paper towels, and nonwoven wipes and mop pads. Each of the sheets includes a front surface and a rear surface. The front surface of one sheet is connected with the rear surface of an adjacent sheet to form the roll by connectors such as male and female hook and loop ribbon sections. The individual sheets can also be used as mop head covers. A dispenser for the sheets includes a spindle for rotatably retaining the roll and a rack for supporting a detached sheet for air drying between uses.

4 Claims, 3 Drawing Sheets

ROLL OF INTERCONNECTED DETACHABLE FABRIC/CLOTH SHEETS

CROSS-REFERENCE TO RELATED APPLICATIONS

Priority is claimed on Provisional Patent Application Ser. No. 61/003,838 filed Nov. 20, 2007.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1 . Field of the Invention

The present invention relates to absorbent fabric or cloth sheets or towels used for cleaning, drying or wiping that may be detachably interconnected in a roll.

2 . Description of Prior Art Including Information Disclosed Under 37 CFR 1.97 and 1.98

Rolls of paper towels formed of a continuous strip of paper perforated at spaced intervals such that individual towels can be removed by tearing along the perforations are used in great numbers for multiple purposes of cleaning, drying and wiping various articles and surfaces. Such paper towels, as well as nonwoven wipes and mop pads, are disposable products that can be used only a limited number of times and then must be discarded. This is environmentally undesirable because they consume vast resources and dramatically increase the amount of solid waste in landfills. Further, there are financially undesirable because they are very costly to the consumer.

My invention addresses these disadvantages in a simple and cost-effective manner by providing a non-paper alternative for such disposable products which is easy to use, is more durable and can be reused hundreds of times, at much less cost than the disposable products to obtain a comparable amount of cleaning, drying and wiping.

As described in detail below, my invention relates to reusable fabric or cloth sheets which can be formed into a roll and to a dispenser designed for use therewith.

BRIEF SUMMARY OF THE INVENTION

My invention relates to reusable fabric or cloth sheets designed for cleaning, drying and wiping. The sheets can be connected to each other to form a roll. The sheets are detached from each other as needed.

Each of the sheets includes a front surface and a rear surface. Means are provided for detachably connecting the front surface of one sheet with the rear surface of an adjacent sheet to form the roll.

The detachable connecting means preferably include male and female connectors. One of the connectors is fixed to the front surface of one of the sheets. The other of the connectors is fixed to the rear surface of the adjacent sheet.

Each of the front and rear sheet surfaces has an edge portion. Preferably, one of the connectors is fixed to the edge portion of the front surface of one sheet and the other of the connectors is fixed to the edge portion of the rear surface of the adjacent sheet.

The connecting means preferably take the form of sections of hook and loop ribbon.

In accordance with another aspect of the present invention, instead of being formed into rolls, the fabric or cloth sheet may be designed for use in combination with a mop having a head. The sheet is mounted over the mop head by placing the sheet around the mop head and connecting the hook and loop ribbon sections.

In accordance with another aspect of the present invention, a dispenser is provided for use with the roll of interconnected detachable fabric or cloth sheets. The dispenser includes means for retaining the roll such that sheets can be removed from the roll as needed. The dispenser also includes a rack for supporting a sheet removed from the roll such that it can be air dried between uses.

In its preferred form, the roll retaining means includes a base and a spindle adapted to receive the roll in a manner that permits the roll to rotate freely such that sheets can be removed from the roll as required. The rack includes a horizontally extending support over which a used sheet can be draped to permit the sheet to air dry between uses. Both free standing and wall mounted embodiments of the dispenser are disclosed.

It is, therefore, a prime object of the present invention to provide a roll of interconnected detachable fabric or cloth sheets and a dispenser therefore.

It is another object of the present invention to provide a roll of reusable interconnected detachable fabric or cloth sheets.

It is another object of the present invention to provide a roll of reusable interconnected detachable fabric or cloth sheets that can be used for cleaning, drying and wiping in a manner similar to that of paper towel and nonwoven disposable wipes and mop pads.

It is another object of the present invention to provide a roll of environmentally friendly interconnected detachable fabric or cloth sheets that can be used in a manner similar to that of paper towel and nonwoven disposable wipes and mop pads.

It is another object of the present invention to provide a reusable fabric or cloth sheets that can be used in conjunction with a mop as a mop pad.

It is another object of the present invention to provide a dispenser for a roll of environmentally friendly interconnected detachable fabric or cloth sheets.

It is another object of the present invention to provide a dispenser for a roll of environmentally friendly interconnected detachable fabric or cloth sheets that includes a rack for supporting a sheet for air drying between uses.

BRIEF DESCRIPTION OF THE SEVERAL VIEWS OF DRAWINGS

To these and to such other objects that may hereinafter appears, the present invention relates to a roll of interconnected detachable fabric or cloth sheets and a dispenser therefore as described in detail in the following specification and recited in the annexed claims, taken together with the accompanying drawings, in which like numerals refer to like parts and in which:

DETAILED DESCRIPTION OF THE INVENTION

Figure 1:
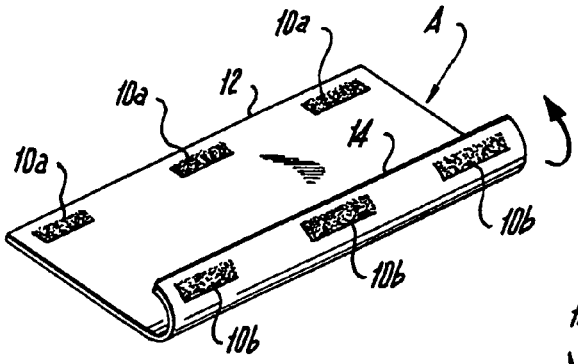
FIG. 1 is a perspective view of a fabric or cloth sheet in accordance with the present invention with one edge bent over to reveal the detachable sheet connecting means on both surfaces of the sheet.
Figure 2:
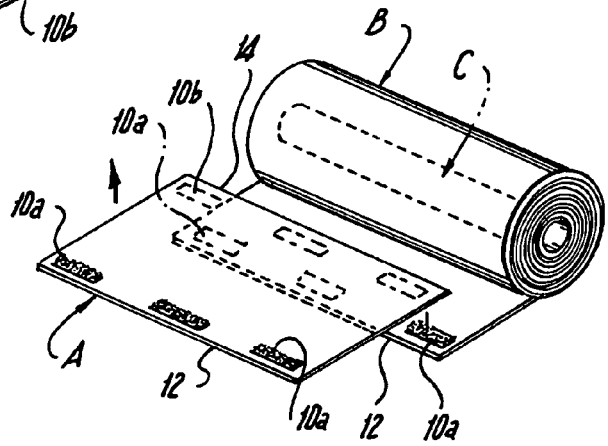
FIG. 2 is a perspective view of a roll formed of sheets in accordance with the present invention showing the leading sheet exploded from the adjacent sheet.

As illustrated in FIG. 1, the present invention relates to individual sheets of absorbent fabric or cloth material, generally designated A. Sheets A may be connected together to form a strip which may be wound into a roll, generally designated B. Preferably, the multi-sheet strip is wound about a hollow core, generally designated C, to form the roll, as illustrated in FIG. 2.

Figure 5:
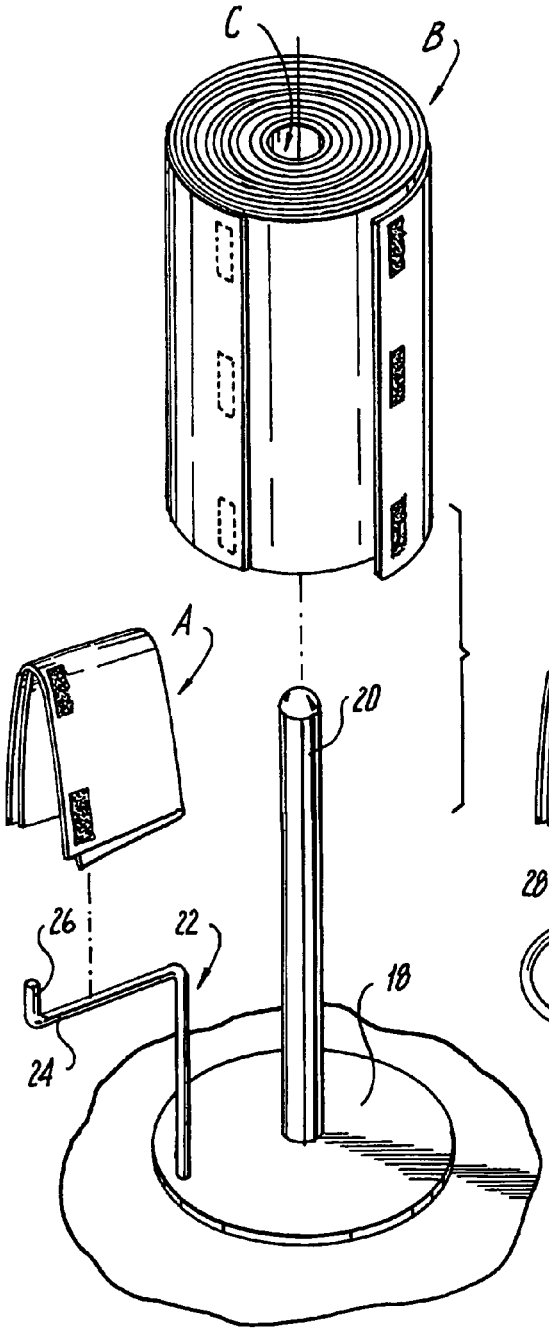
FIG. 5 is a perspective view of a first preferred embodiment of a free standing dispenser of the present invention showing the roll and a detached sheet in exploded positions.
Figure 6:
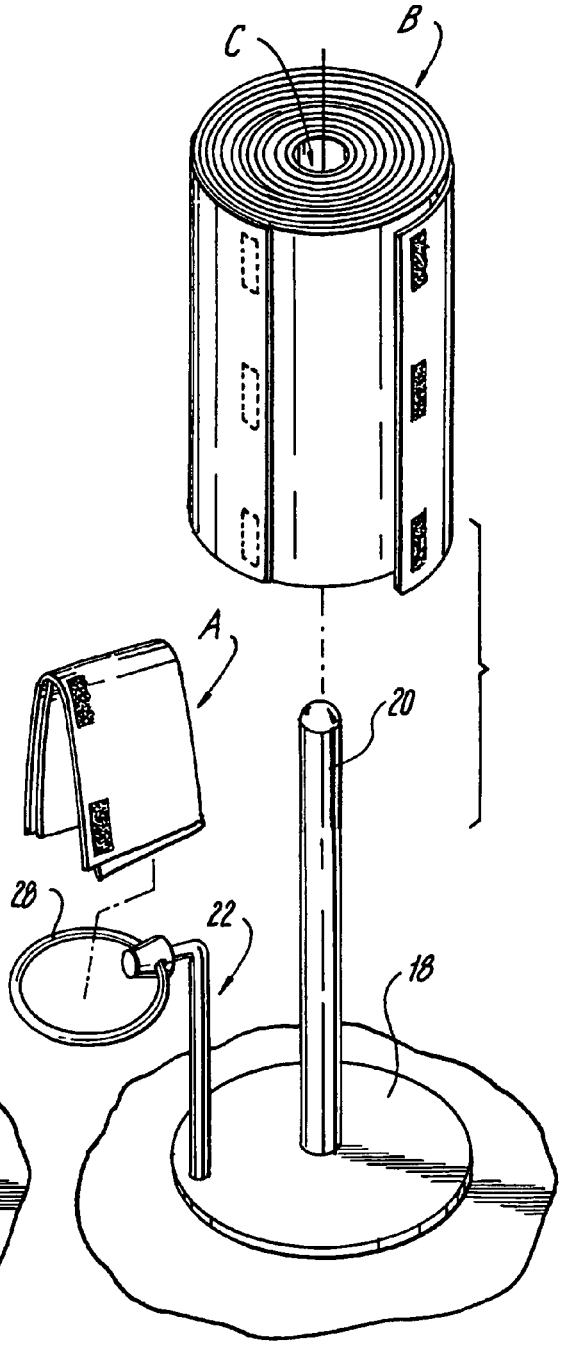
FIG. 6 is a perspective view of a second preferred embodiment of a free standing dispenser of the present invention showing the roll and a detached sheet in exploded positions.
Figure 7:
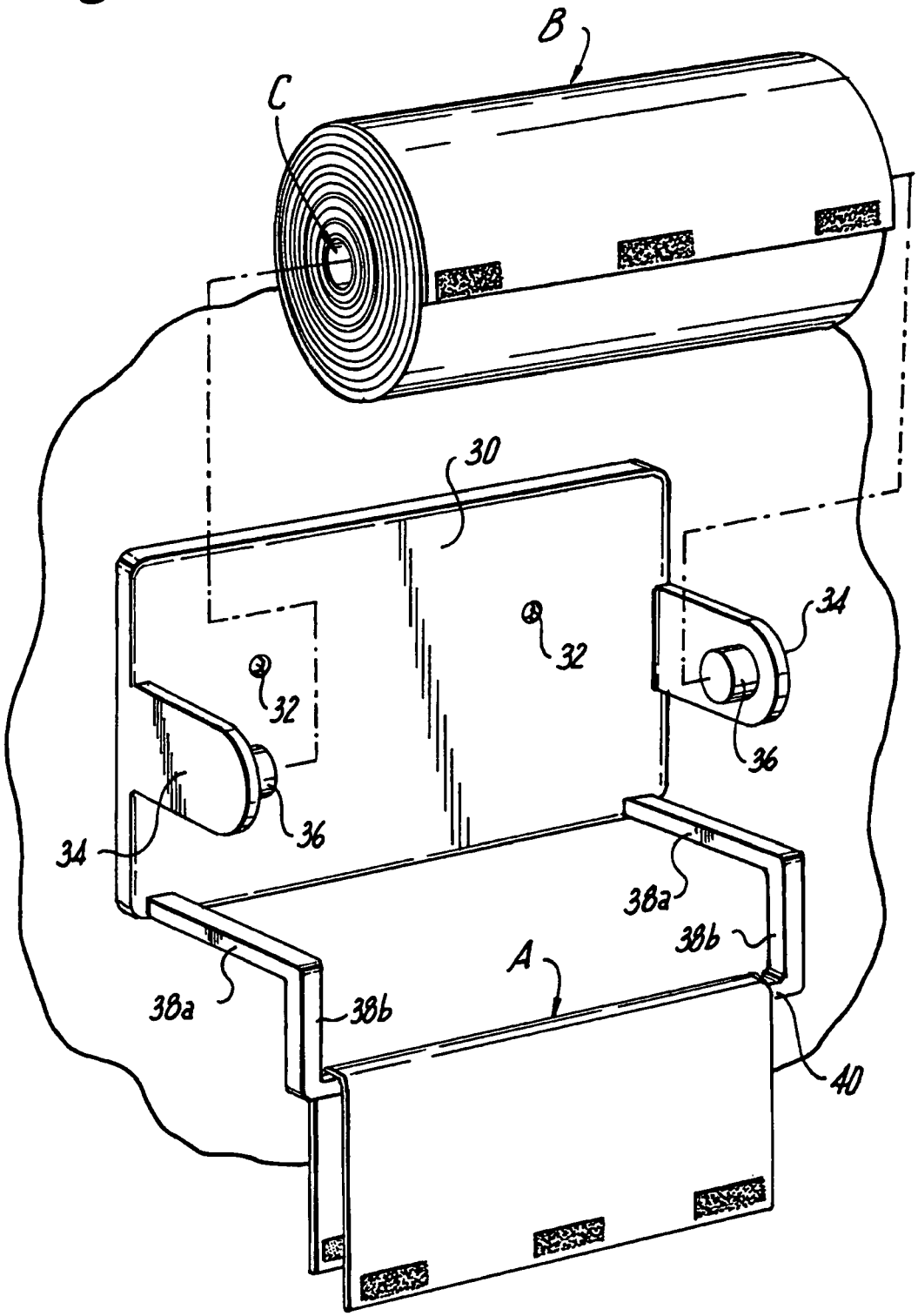
FIG. 7 is a perspective view of a first preferred embodiment of a wall mounted dispenser of the present invention showing the roll and a detached sheet in exploded positions.

Sheets A are fabricated of washable fabric or cloth material so as to be reusable, and thus are designed for multiple uses and applications. Sheets A are interconnected in a manner that permits them to be easily detached from each other for cleaning, drying or wiping. Roll B of interconnected sheets A can be used with a dispenser, such as illustrated in FIGS. 5, 6 and 7, which retains the roll and permits the removal of sheets, one at a time, from the roll. Preferably, the dispenser includes a rack for the temporarily supporting a detached sheet for air drying between uses.

Sheets A have opposing front and back surfaces. The sheets are detachably connected together by any conventional flexible, washable connecting means. The connecting means should allow the sheets to be easily detached from one another by pulling the sheets apart, and to be reattached to each other by reattaching the connecting means to form a strip of sheets which can conveniently form a roll.

In the preferred embodiment illustrated in the drawings, the connecting means takes the form of sections or strips 10 of hook and loop tape or ribbon fastener which permit easy detachment and reconnection of the sheets, will not scratch surfaces that come into contact with the sheets as they are used, and allow for repeated washing of the sheets without losing its ability to connect and detach. The connecting sections 10 may be attached to the sheets by any conventional means, such as sewing, adhesive or the like. The connecting means 10 can also serve to anchor the inner most sheet of a strip of sheets to core C, for example a cardboard or plastic tube, such that the roll of sheets can be used with most paper towel dispensers.

As seen in FIGS. 1 and 2, connecting strips 10 of sheet A consist of sections of male and female hook and loop ribbon 10*a* and 10*b*, respectively. The male connecting sections 10*a* are preferably situated on one surface of the sheet, proximate one edge 12 thereof. The female connecting sections 10*b* are preferably situated on the opposite surface of the sheet, proximate the edge 14, opposite edge 12. The figures illustrate the use of sets of sections 10*a* and 10*b* consisting of there spaced aligned sections each. However, different numbers of sections in the sets can be used as necessary.

After being removed from the roll, each sheet A can be used multiple times sequentially and cleaned with water until soiled. Once soiled, the sheet may be placed in a small receptacle, under-the-counter hamper or storage bin. After the receptacle is full, the sheets can be clean in the washer/dryer and reconnected to one another to form a strip. The strip can be attached to the core and wound back into a roll. The detachable sheets on the roll can be used over and over again.

Figure 3:
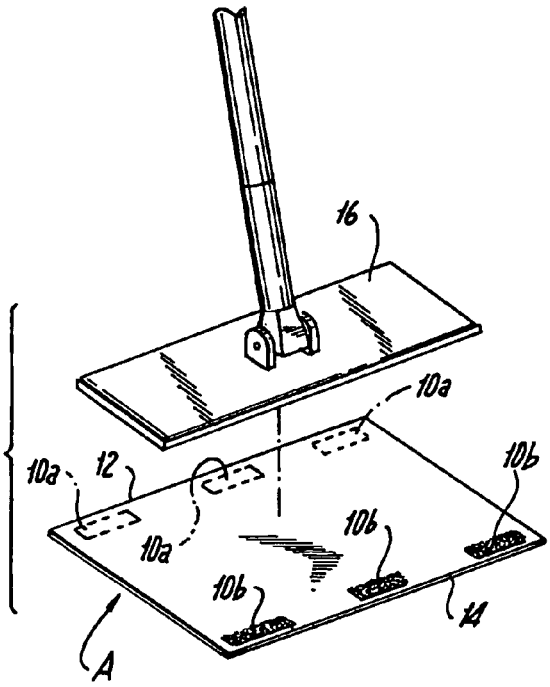
FIG. 3 is a perspective view of a mop head aligned with a mop pad formed of a fabric or cloth sheet of the present invention.
Figure 4:
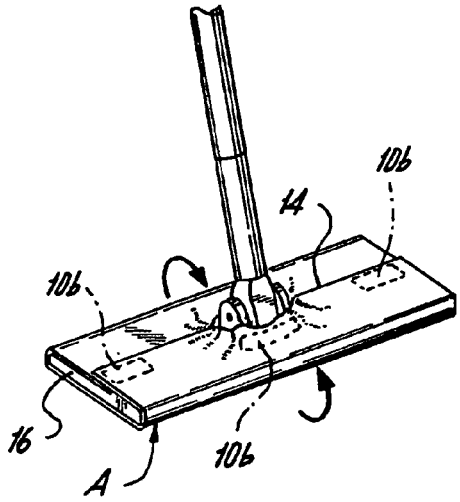
FIG. 4 is a view similar to FIG. 3, but showing the sheet of the present invention mounted on the mop head.

FIGS. 3 and 4, illustrate another use of sheets A, as a reusable and removable pad cover for a mop head 16. The sheet is simply aligned with the mop head (FIG. 3) and then the edge 12, 14 of the sheet are folded around the mop head until the edges overlap such that connecting strips 10*a* engage connecting strips 10*b* (FIG. 4) to mount the sheet on the mop head. The assembly can then be used as any conventional mop.

Once the sheet is soiled, it can be removed from the mop head by disconnecting the connecting strips 10 and replaced by a fresh sheet. After removal, the sheet can be cleaned and used multiple times.

FIGS. 5 and 6 illustrate two preferred embodiments of free standing dispensers for the sheets of the present invention. In each case, the dispenser includes a circular base 18 having an upper surface upon which a vertically extending elongated spindle 20 is mounted. Spindle 20 is adapted to be received within core C such that roll B can rotate freely relative to base 18 and sheets A can be removed, one at a time, as needed.

Each dispenser is provided with a rack for supporting a detached sheet to permit same to air dry between uses. In each dispenser, the rack consists of a vertical section 22 extending upwardly from base 20 in a direction substantially parallel to and spaced from the axis of spindle 18. In each case, the rack also includes a substantially horizontal section extending from the upper end of vertical section 22 adapted to support a sheet A. In FIG. 5, the horizontal section takes the form of a bar 24 with an upstanding part 26 at the end which prevents the sheet from accidentally falling off the end of section 24. In FIG. 6, the horizontal support section takes the form of a ring 28.

FIG. 7 illustrates the first preferred embodiment of a wall mounted dispenser which includes a substantially rectangular base 30 having spaced holes 32 for mounting the dispenser to a wall or other vertical surface by screws (not shown) or other conventional fastening means. Extending outwardly from the surface of base 30 are a pair of oppositely oriented parts 34 upon which inwardly extending aligned protrusions 36 are mounted. Roll B fits between parts 34 with protrusions 36 situated in opposite ends of core C such that roll B can rotate freely with respect to plate 30.

Extending outwardly from the bottom portion of plate 30 is a rack for supporting a sheet A consisting of spaced brackets 38, each including a horizontal part 38*a* and a vertical part 38*b*. Extending between the lower ends of vertical parts 38*b* is a horizontal support bar 40 upon which a sheet A can be air dried between uses.

The invention is a very green, environmentally friendly product, more durable, more economical, and more attractive than paper towel and nonwoven rolls and wipes. Consumers can do their part to save the environment by using the invention to reduce their dependence on disposable paper towels and nonwovens, thus saving paper, trees and an enormous amount of solid waste in landfills.

The invention essentially saves money and the environment with the positive result of replacing many rolls of paper towels and nonwoven wipes consumed, and realizing the tremendous cost benefit of the invention's long-life as a reusable product.

The reusable sheets are designed to be washed in washers and dryers like garments for many multiple uses and accordingly are much stronger and more durable than paper towels. They are also provide a much stronger wiping, drying and cleaning alternative to paper towels and nonwoven wipes. Since this product is reusable many times over, it will represent added convenience and a huge dollar savings to the consumer, as compared to disposable paper towels and nonwoven wipes.

The sheets can be made of different attractive fabrics and in various sizes for many different applications. For example, in residential kitchens, the interconnected detachable fabric/cloth sheet roll can be made in many kitchen design styles and fabric weights and in a size similar to paper towels. The product can be used for replacement of paper towels and paper napkins. In residential bathrooms, the interconnected detachable fabric/cloth sheet roll can be made in bathroom design styles and in a size similar to small washcloths.

Many other applications are possible. For example, the sheet rolls can be used in workshops, restaurants, hotels, and restrooms. Custom personalized design on the fabrics is another alternative product option.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A roll of interconnected washable and reusable absorbent fabric or cloth sheets, each of said sheets comprising a front surface and a rear surface, and washable means for detachably connecting said front surface of one sheet and the rear surface of an adjacent sheet, wherein said washable detachable connecting means comprises interengaging connectors, one of which is fixed to the front surface of one sheet and the other of which is fixed to the rear surface of an adjacent sheet, said roll further comprising a core, said interconnected sheets being wound about and releasably anchored to a surface of said core by washable hook and loop fasteners, one of said washable hook and loop fasteners being fixed to the innermost sheet of said roll and the other of said washable hook and loop fasteners being fixed to said surface of said core, such that after use, said sheets may be washed, reconnected into a roll with the innermost sheet anchored to said core, and reused.

2. The roll of claim 1 wherein each of said sheets has a first edge portion and a second edge portion extending between side portions and wherein said connectors are fixed to the sheet only proximate the first and second edge portions, and not along the side portions therebetween, such that the sheets do not adhere to each other along the side portions.

3. The roll of claim 1 wherein each of said sheet surfaces has an edge portion and wherein one of said connectors is fixed to said edge portion of said front surface of said one sheet and the other of said connectors is fixed to said edge portion of said rear surface of said adjacent sheet.

4. A roll of interconnected washable and reusable absorbent fabric or cloth sheets, each of said sheets comprising a front surface and a rear surface, and washable means for detachably connecting said sheets, said washable detatachable connecting means comprising connectors, one of which is fixed to the front surface of one sheet and other of which is fixed to the rear surface of an adjacent sheet, each of the sheets having a first edge portion and a second edge portion extending between side portions, wherein said connectors are fixed to said sheet only proximate the first and second edge portions, and not along the side portions, said roll further comprising a core, said interconnected sheets being wound about and releasably anchored to a surface of said core by washable hook and loop ribbon fasteners, one of said washable hook and loop fasteners being fixed to the inner most sheet of said roll and the other of said washable hook and loop fasteners being fixed to said surface of said core, such that after use, said sheets may be washed, reconnected into a roll with the innermost sheet anchored to said core, and reused.

* * * * *